US005901506A

United States Patent [19]

Zicaro et al.

[11] Patent Number: 5,901,506

[45] Date of Patent: May 11, 1999

[54] COMPOSITE CONCRETE AND PLASTIC MANHOLE SYSTEM

[75] Inventors: Joseph P. Zicaro, Magnolia, Tex.; Ronald Eldon Bailey, II, Scottdale, Ariz.

[73] Assignee: Hydro Conduit Corporation, Houston, Tex.

[21] Appl. No.: 08/938,275

[22] Filed: Sep. 26, 1997

Related U.S. Application Data

[ 60] Provisional application No. 60/028,244, Oct. 9, 1996.

[51] Int. Cl.[6] ..... E02D 29/14

[52] U.S. Cl. ..... 52/20; 52/245

[58] Field of Search ..... 52/20, 21, 244, 52/245, 249; 404/25, 26

[56] References Cited

U.S. PATENT DOCUMENTS

| | | | |
|---|---|---|---|
| 1,016,506 | 2/1912 | Kretchmer | 52/245 X |
| 3,715,958 | 2/1973 | Crawford et al. . | |
| 3,938,285 | 2/1976 | Gilbu . | |
| 3,974,599 | 8/1976 | Grosh . | |
| 4,089,139 | 5/1978 | Moffa et al. . | |
| 4,540,310 | 9/1985 | Ditcher et al. . | |
| 5,383,311 | 1/1995 | Strickland . | |
| 5,386,669 | 2/1995 | Almeida . | |

FOREIGN PATENT DOCUMENTS

| | | | |
|---|---|---|---|
| 210993 | 5/1956 | Australia | 52/245 |
| 50543 | 12/1940 | France | 52/245 |
| 89 0727 | 2/1943 | France | 52/245 |
| 181384 | 11/1962 | Sweden | 52/245 |
| 668134 | 3/1952 | United Kingdom | 52/245 |

*Primary Examiner*—Creighton Smith
*Attorney, Agent, or Firm*—Baker & Botts, L.L.P.

[57] ABSTRACT

A composite manhole unit comprising a plastic inner element and an outer skeletal frame made of a structural material is provided. The plastic inner element is fitted within the skeletal frame, leaving large sections of the plastic inner element exposed. The exposed plastic sections can be readily cut in the field as necessary for attaching inlet and outlet pipes. A plurality of manhole units may be combined and assembled in a stacked manner to form a manhole system. The plastic pipe sections are sealed or connected to each other in a water-tight manner while the skeletal frame of the respective manhole units rest upon each other. The skeletal frame provides the structural support for the manhole unit and system. The excessive weight of the system and each respective manhole unit is reduced by using the skeletal frame in combination with the plastic inner element. The plastic inner element protects the skeletal frame from the corrosive atmosphere within, for example, a sewer system.

23 Claims, 5 Drawing Sheets

FIG. 1
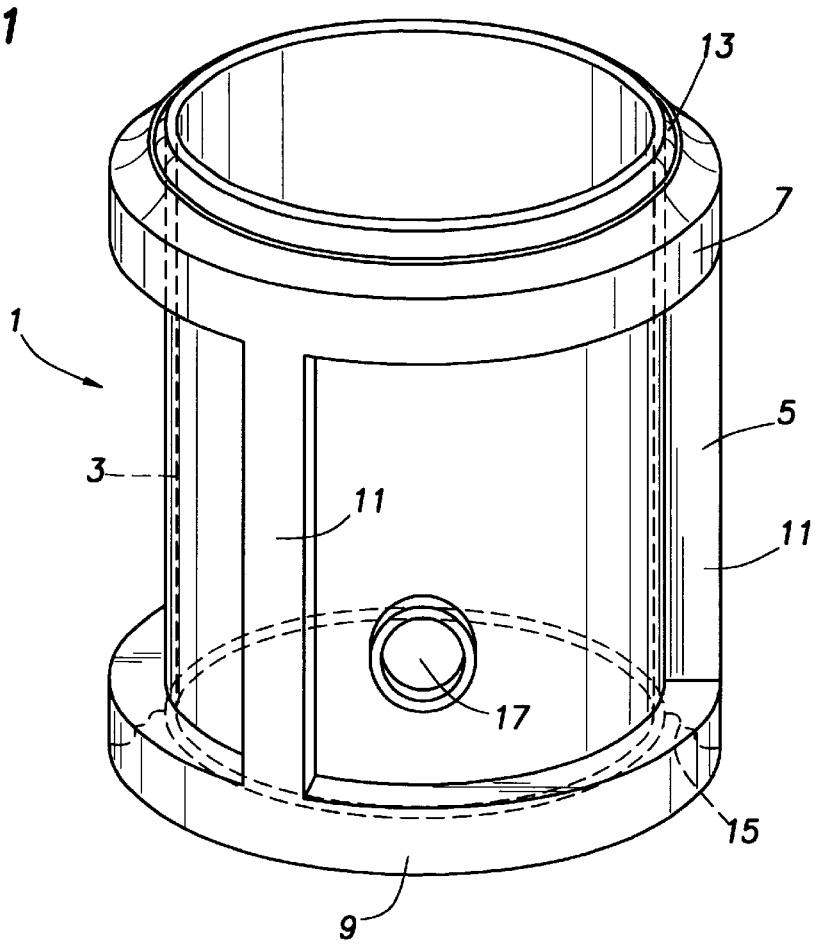
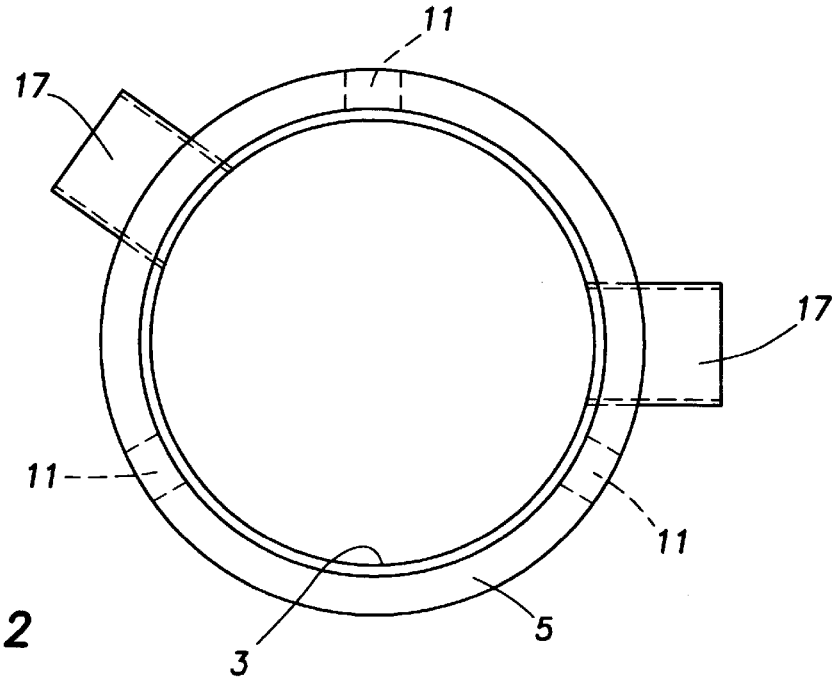
FIG. 2

FIG.5
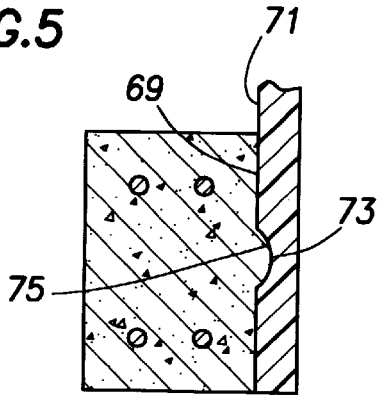
FIG.6
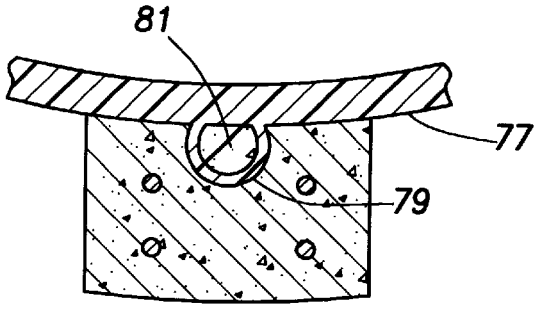
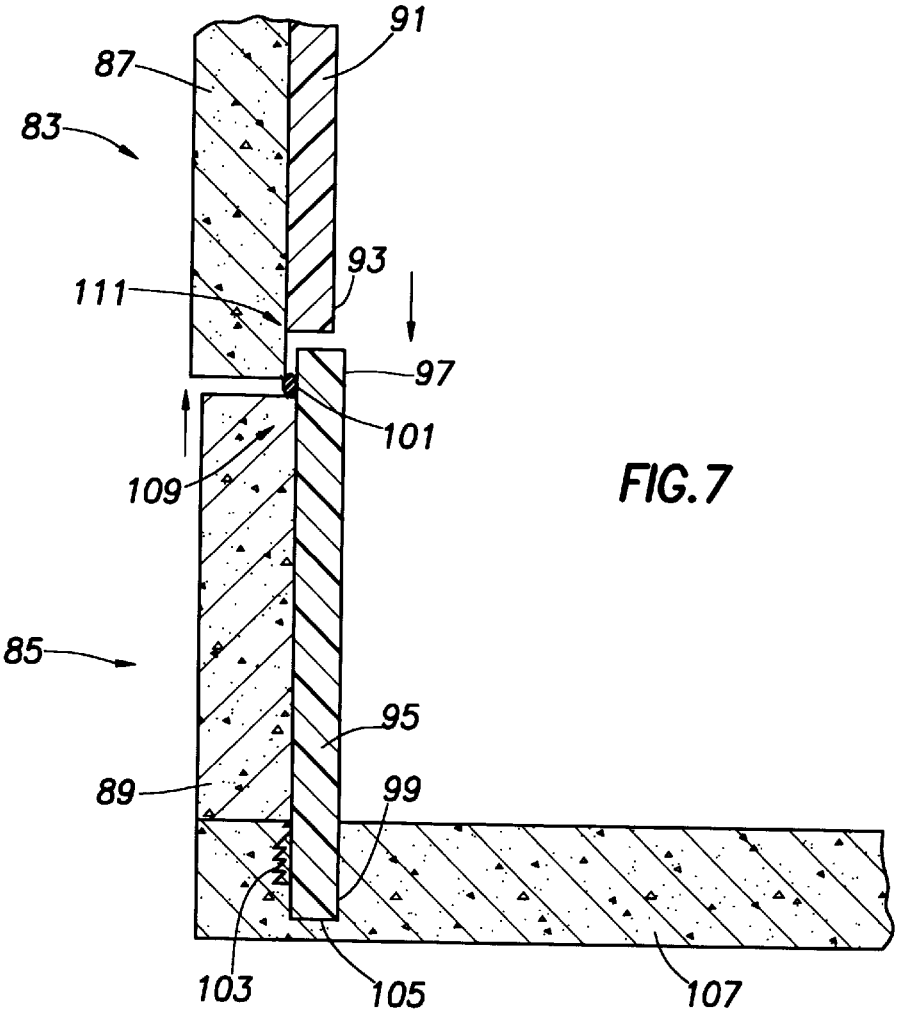
FIG.7

FIG.8
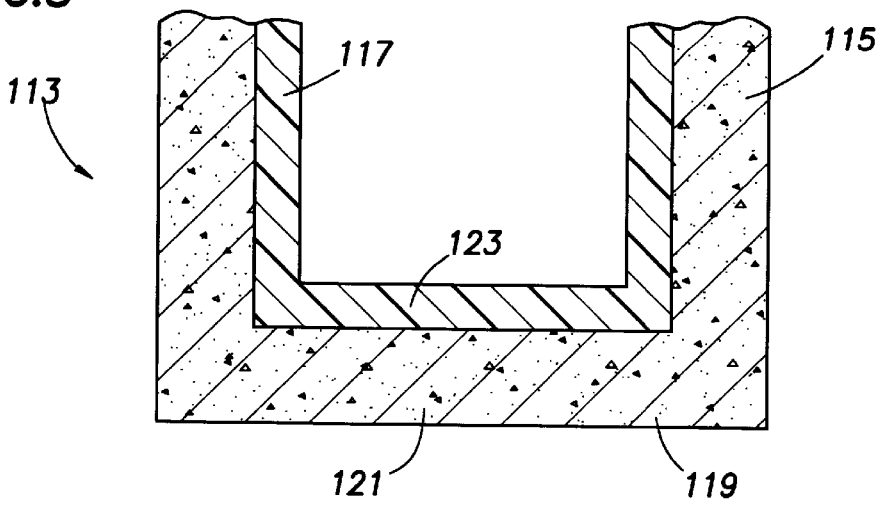
FIG.9
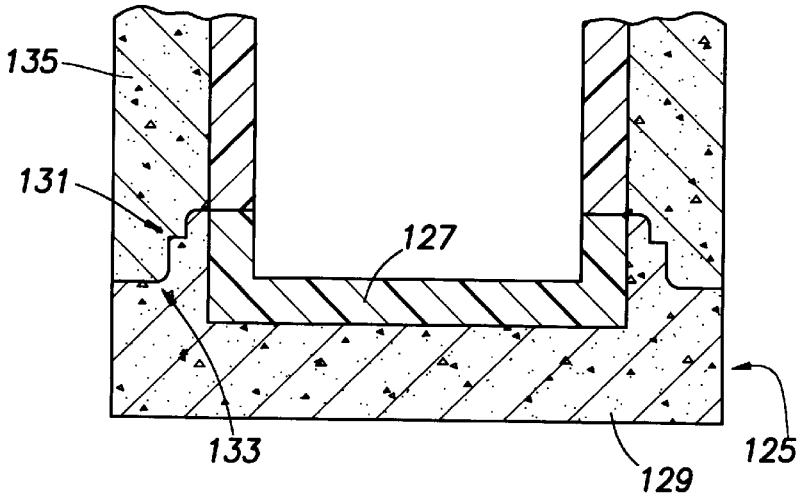
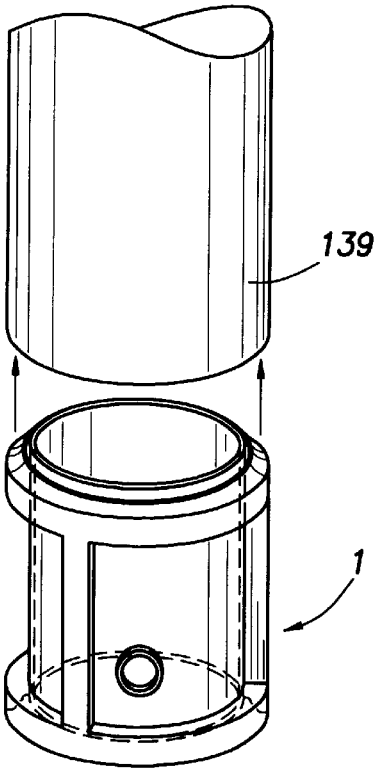
FIG.11

COMPOSITE CONCRETE AND PLASTIC MANHOLE SYSTEM

CROSS REFERENCE TO PROVISIONAL APPLICATION

This application claims the benefit of U.S. Provisional Application No. 60/028,244, filed Oct. 9, 1996.

BACKGROUND OF THE INVENTION

1. Field of the Invention

The present invention relates generally to manholes and to the construction, replacement and alteration of such structures in the field. More particularly, the invention relates to a composite manhole system comprising a corrosion resistant plastic cylinder surrounded by a rigid concrete frame which provides structural integrity but does not entirely encapsulate the plastic cylinder, thus facilitating manipulation in the field.

2. Discussion of the Prior Art

Manhole structures provide access to underground facilities, such as sewer systems and pipelines, for the purposes of repair, cleaning, maintenance and inspection. For convenience, manholes are usually placed at frequent intervals along a sewer line. In addition, manholes often provide a junction point for two or more intersecting pipelines.

There are numerous problems associated with present manhole technology, many of which relate to the harshness of the environment. Manholes are constantly exposed to eroding, oxidizing and corrosive elements associated with the soil on the outside and with the acidic sewage that flows on the inside. The concrete frequently used to construct manholes provides the strength necessary to withstand some of the harshness of the environment and load concentration.

The inflow of rainwater into sewer systems causes overloading of sewer plants, resulting in increased expenses associated with the treatment of larger flow volumes. Studies have shown that inflow and infiltrating rainwater can increase the flow in a sewer system up to 40% and that up to 75% of such inflow may result from defects in manholes. Exfiltration from manholes allows seepage of raw sewage into the surrounding soil and eventually into rivers and streams. This defeats the whole purpose of a sewer system, which is to isolate raw sewage away from the rest of the water supply until it can be treated and detoxified.

Another drawback to common manhole technology relates to the difficulty of construction and assembly. Manhole structures are commonly built using brick, tile or concrete, making it necessary to build or cast the structures in place in the field. This adds extra labor costs which could be greatly reduced using prefabricated manhole systems. However, even precast concrete manholes are problematic because they are heavy and difficult to manipulate. Also, concrete manholes are difficult to cut, decreasing their versatility in situations where it becomes necessary to connect new inlet and outlet pipes. Moreover, concrete manholes, whether they are precast or constructed in the field, are still highly subject to corrosive forces and joint leaks at the connections.

The problems associated with conventional concrete manhole technology have led workers in the field to utilize prefabricated manhole structures made of reinforced plastic. For example, U.S. Pat. Nos. 3,715,958 and 3,938,285 both teach large, preformed manhole structures made entirely of plastic and glass fiber. These structures effectively overcome the problems of corrosion associated with conventional concrete manhole technology but they are bulky, difficult to handle, expensive to ship and lack the versatility required for proper sizing and customization to a particular site. Furthermore, they lack structural integrity and resistance to crushing by external forces.

To add strength and versatility to preformed plastic manholes, improvements such as stackable segments and plastic ribs or stiffeners have been developed. For example, U.S. Pat. No. 3,974,599 teaches an underground vault or manhole featuring increased rigidity of the body by the addition of reinforced plastic mortar rings and struts. In addition, U.S. Pat. No. 4,089,139 teaches stackable manhole units with internal reinforcing ribs which are an integral part of the body of each unit.

U.S. Pat. No. 5,386,669 further improves upon manhole technology by disclosing a complex modular manhole system comprising stackable double-walled units. The double walls give two potential sources of strength. First, the cavity between the walls may be filled with a structural material such as concrete that can be pumped through a hole drilled in the upper portion of each unit. Second, adjacent recesses are placed in the outer walls of some units to form structural ribs between the recesses. One disadvantage of this type of system is that the use of rebar to reinforce the concrete poured into the units is difficult and impractical. A second disadvantage is that, once the concrete is poured into the units, the manhole is entirely encapsulated by a thick, hard shell, making it difficult to later cut through the structure when it becomes necessary to splice in new pipelines.

Other patents have also disclosed manhole technology which takes advantage of the strength of concrete and the corrosion resistance of plastic. U.S. Pat. No. 4,540,310 discloses a manhole system comprising a stackable concrete lower section and an upper plastic cylindrical sleeve which has a integral flange extending outwardly from the bottom. The bottom of the sleeve including the flange is integrally cast into the top concrete riser section of the lower concrete structure. When the whole structure is placed underground, the top plastic sleeve is surrounded by the sleeve portion of an iron frame and grade rings of a desired thickness, the lower most of which contacts the flange portion of the iron frame. The manhole cover rests on the top of the sleeve portion of the iron frame. The grade rings are required to bring the manhole cover up to grade level. This sleeve is advantageous because it can be made extra long, preincorporated into the concrete riser section, and then cut to the desired height at the jobsite. One disadvantage of the system is that the bottom section is made entirely of concrete and is subject to the typical corrosive forces and joint leaking problems discussed above. Another disadvantage is that the plastic is only used for the top sleeve portion and is fully encapsulated by the surrounding iron frame. Although this frame provides necessary structural reinforcement, it does not allow workers easy access when it becomes necessary to splice a new pipeline into the plastic sleeve.

U.S. Pat. No. 5,383,311 discloses a manhole system wherein concrete is cast against a plastic preshaped liner containing integral, hollow, outward projections. Once the concrete is cast, the hollow projections become filled with concrete and protrude into the resulting outer layer of concrete, forming a tight lock between the plastic liner and the concrete. This system is disadvantageous because the liner is entirely encapsulated by concrete, making the unit extremely heavy and difficult to manipulate. In addition the encapsulation by concrete makes it extremely difficult to cut as necessary to add pipe connections.

As seen above, the prior manhole technology is not sufficiently versatile and suffers from various disadvantages and problems. For example, prior art that employs concrete by itself allows for corrosion and deterioration over time. On the other hand, plastic alone does not provide the strength that concrete does. The prior art that discloses the use of both plastic and concrete does not allow for easy access to the plastic for the purpose of splicing in new pipelines. Moreover, the technology disclosed by the prior art is highly labor and cost intensive, owing either to the amount of construction which must be done at the jobsite or to the difficulty of manipulating the bulky components of such manhole systems.

SUMMARY OF THE INVENTION

A need exists for a versatile manhole technology that fully utilizes the corrosion resistance of plastic, resins or fibreglass and the strength of concrete or metal, yet allows easy access for splicing in new pipelines. The present invention is a composite manhole unit manufactured from plastic and either concrete or metal such that the primary structural strength is obtained from a concrete or metal skeletal frame, generally of a hollow cylindrical shape. The corrosion resistance is provided by a plastic inner element, generally of a hollow cylindrical shape, which is easily cut in the field for the purpose of inserting pipeline connections. The system is unique in that the plastic portion is not entirely encapsulated by the frame, leaving large sections of plastic that are exposed. The exposed plastic sections can be readily cut in the field as necessary for inlet and outlet pipes to be inserted, using a rubber gasket to form a seal. This eliminates the need to cut through concrete to insert connectors.

Structural load bearing strength is provided by girders which encircle (or surround) the plastic inner element and by wall columns which connect and support the girders. The girders are substantially horizontal and the columns are substantially vertical, though these elements may be placed at up to 45° angles, as in, for example, a lattice configuration. The skeletal or lattice-like structure of the frame, as opposed to a full concrete wall surrounding the plastic for the entire length of the manhole, reduces the material required to manufacture the manhole. This reduction in the use of support material will decrease the overall weight of the manhole units, further facilitating manipulation in the field. Furthermore, the spaces between the wall columns and girders allow for easy access to the inner element for the purposes of fitting connections, outlets and other devices.

To facilitate building a manhole system, the units are stackable and contain a joint projection or protrusion (male joint) which extends or protrudes from the top girder of one unit and fits with a recessed mating joint (female joint) in the bottom of another unit. Of course, the units may be used in either orientation and top and bottom as described herein are used only for convenience and consistency.

Alternatively, a single manhole unit as described herein may be used with the manhole devices of the prior art. For example, it may be desirable to employ the unit of the present invention as the bottom unit of a manhole, retaining the existing system of concrete devices above it. Additionally, a single long unit may be employed in a manhole as opposed to multiple stacked units. Further, multiple skeletal frames may be combined with a single long inner element that can easily be cut to size in the field. The use of long inner elements in combination with multiple frames minimizes the possibility of leakage at the joints.

The linkage between the units may be constructed in a variety of ways using the known art for joint construction. Further, the joints may be sealed to provide a watertight linkage with adhesives, solvents, heat or gasket-like devices. Gasket-like devices include O-rings, D-rings, wedge-shape rings and the like, as well as profile gaskets. Further, multiple gaskets may be employed at different surfaces of the junction and may be combined with other sealing methods such as liquid gaskets, adhesive materials, and solvent or heat welding of the plastic surfaces.

In one embodiment of the invention, the joint comprises a projecting male surface that mates with a recessed female surface. The surfaces of the joint protrusion and mating joint may be angled and/or curved to facilitate a tight seal between units. The mating surfaces may be contained within the frame, leaving the inner elements to merely fit more or less flush against each other, or alternatively, the inner element may also have mating surfaces. The inner element may be flush with the frame, or not, depending on the mating surfaces employed. One or more mating surfaces may be sealed in an appropriate fashion.

In another embodiment of the system, either the inner element or the frame contains small indentations. These indentations may be filled with a corresponding protuberance from the other portion of the unit or may be wholly or partially filled with a grommet-like device which functions to accommodate the differential expansion rates of the two portions of the unit. The use of an indentation/protuberance system functions to increase the friction between the inner element and the skeletal frame, thus holding the components in place.

Once the system is constructed, a lid or riser can be fitted with the joint protrusion of the top unit and an optional sealing disk can be fitted to the mating joint of the bottom unit to seal the system. To further seal the system, the bottom-most unit, with the sealing disk, can be cast in concrete. Alternatively, a special bottom unit may be prefabricated that is complete with its own base for the cylinder. The special bottom inner sleeve has an integral base, thus minimizing the possibility of joint leakage. The special bottom frame likewise is manufactured with an integral base. Alternatively, a regular frame unit can be combined with a sealing disk that has a special inner element with integral base. The frame of the sealing disk may be skeletal or solid as desired, but a skeletal base has the advantage-of minimizing the weight of the frame.

The invention is a manhole unit with a rigid, skeletal, exterior frame having an inner surface and an inner element made of a corrosion resistant material and having an outer surface. The inner element is positioned within the exterior frame such that the inner surface faces towards (is adjacent to) the outer surface. The exterior frame has a plurality of girders encircling the inner element and a plurality of columns connecting the plurality of girders. Each of the plurality of columns is equally spaced around the inner element. The plurality of girders include a top girder with a first joint protrusion and a bottom girder with a first mating joint. The first mating joint is shaped to receive a second joint protrusion of a first adjacent manhole unit and the first joint protrusion is shaped to receive a second mating joint of a second adjacent manhole unit.

The outer surface of the inner element may have a circular or polygonal cross section, in which case the inner surface of the exterior frame preferably conforms and has a similar cross section. The exterior frame may also be coated with a corrosion resistant material such as plastic, fibreglass or paint.

The inner element is maintained within the exterior frame by friction. Friction can be increased with a protuberance on the inner element fitting into a corresponding indention on the exterior frame or vice versa. Alternatively, the indention may be at least partially filled with a grommet to allow for differential expansion of the two units. In yet another embodiment, the inner element and exterior frame have a locking system with a plurality of hollow protuberances projecting from the outer surface of the inner element. Here the exterior frame at least partially fills the plurality of hollow protuberances to lock the pieces together.

Suitable corrosion resistant materials for the inner element include plastic, fiberglass and combinations thereof. A preferred material is plastic such as polyvinyl chloride, polyethylene, polypropylene, polyester and combinations thereof. Suitable materials for the exterior frame include concrete, metal and combinations thereof. If the frame material is concrete, it can also be reinforced with materials including rebar, fibrous material and combinations thereof.

The invention also includes a manhole system made from a plurality of manhole units stacked upon one another. Each of the manhole units is as described above. Individual units of the manhole system can be sealed therebetween. The seal may encompass only the inner element or the exterior frame or both, as desired. Sealing methods include adhesives, gasket-like devices, solvent welding, heat welding and combinations thereof. An alternative manhole system uses a plurality of exterior frames as described fitted over a single inner element.

Modifications to the basic manhole unit include a unit complete with its own base. This manhole unit includes a rigid, skeletal, exterior frame having a first base and an inner surface. The inner element includes a second base and an outer surface. The inner element is positioned within the exterior frame such that the inner surface faces toward the outer surface and the second base is adjacent to the first base. The exterior frame includes a plurality of girders encircling the inner element, a plurality of columns connecting the plurality of girders and the base is preferably a skeletal base, to conserve materials and minimize weight. The top girder of this frame may have either a joint protrusion or a mating joint adapted to conform with an adjacent unit.

DESCRIPTION OF THE FIGURES

FIG. 1 is an perspective view of a composite manhole unit showing the inner element and the rigid, skeletal frame with an inlet/outlet pipe inserted into the inner element.

FIG. 2 is view of a manhole unit from the top showing inlet and outlet pipes connected to the inner element and three columns that are equally spaced around the inner element.

FIG. 5 is a partial cross sectional view of another indentation/protuberance system for increasing the friction between the skeletal frame and the inner element.

FIG. 6 is a partial cross sectional top view of a column and the inner element with a hollow protuberance system for attaching the inner element to the skeletal frame. The hollow protuberance is shown filled with concrete.

FIG. 7 is a partial cross sectional view of two adjacent units with adjacent surfaces that can be sealed with an O-ring gasket. The bottom unit also has a sealing disk attached thereto and is sealed with a profile gasket.

FIG. 8 is a partial cross section of a manhole unit with an integral base comprised of an inner element with a base and a rigid skeletal frame with a base.

FIG. 9 is a partial cross section of a manhole unit sealed with a sealing disk comprised of an inner element of the sealing disk and a frame of the sealing disk. The sealing disk has a joint protrusion adapted to fit the mating joint of the manhole unit.

FIG. 11 is a perspective view of a manhole system which is formed when a single manhole unit is combined with a prior art manhole.

DETAILED DESCRIPTION

Figure 10:
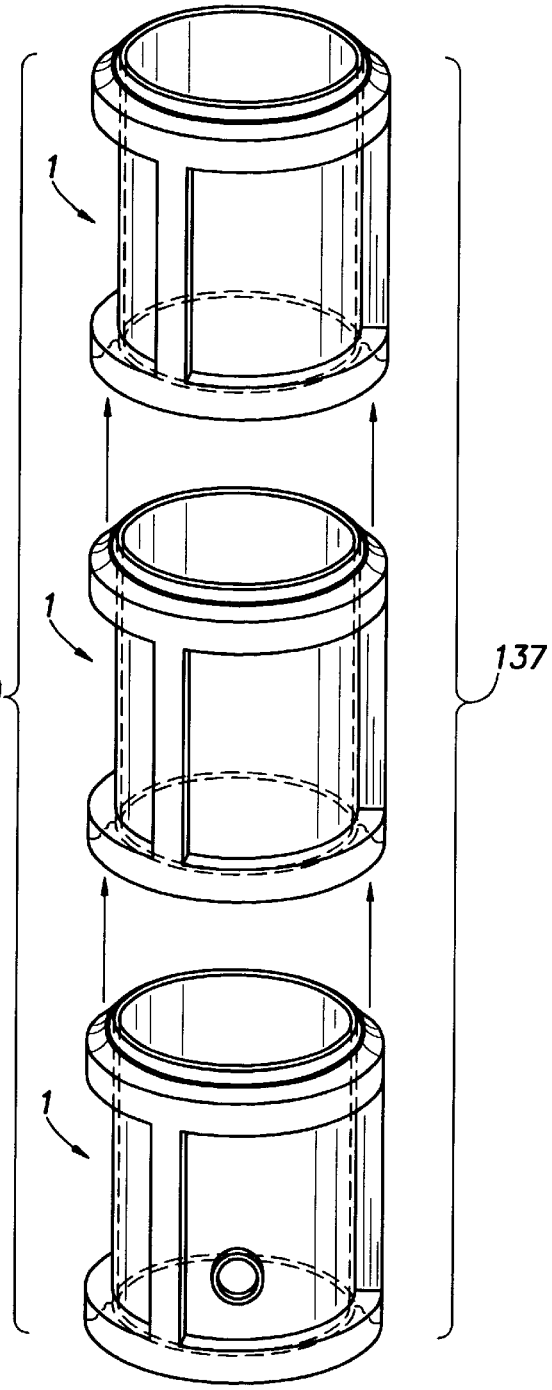
FIG. 10 is a perspective view of a manhole system which is formed when manhole units are stacked one upon the other.

FIGS. 1 and 2 depict an embodiment of a manhole unit 1 according to the present invention. The manhole unit 1 takes advantage of the corrosion resistance of plastic and/or fibreglass and the structural support of reinforced concrete or metal. The unit 1 is better than any of the prior art devices because the inner element is not completely encapsulated by concrete, minimizing the weight of the unit and allowing the plastic to be easily cut in the field to splice in new inlet and outlet pipes. In addition, the unit can be prefabricated in a factory in its final form so that construction and labor costs in the field are minimized. A plurality of manhole units 1 may be stacked together into a manhole system, such as is shown in FIG. 10, that is completely sealed and will not allow any infiltration or exfiltration.

Alternatively, as shown in FIG. 11, a manhole unit 1 may be combined with the manhole devices of the prior art. For example, in applications where only the bottom of the manhole is required to resist corrosion, the bottom may be replaced with a single unit of the invention which is then combined with the existing upper portion of the manhole, or vice versa. Further, the units may be employed in any orientation, for example right-side-up, up-side-down or sideways. The system can be used as a way to access any underground facility, vault, cave, mine, tunnel, compartment or similar structure.

The manhole unit 1 of FIG. 1 generally comprises a hollow cylindrical inner element 3 which is surrounded by a skeletal frame 5. The skeletal frame 5 is preferrably comprised of concrete reinforced with rebar or other fibers, but can also be comprised of metal. The inner element 3 can comprise any corrosion resistant material, preferably a plastic, including, but not limited to, polyvinyl chloride, polyethylene, fiberglass or a combination of plastic and fiberglass.

As shown in FIG. 1, the inner element 3 is essentially a hollow cylindrical tube of corrosion resistant material. It may optionally have a hole cut therein for the insertion of an inlet/outlet pipe 17. The skeletal frame 5 has a top girder 7, a bottom girder 9 and a plurality of columns 11. The top girder 7 is preferrably integrally connected, for example, a unitary construction or welded together, with the columns 11 which extend downward to integrally connect with the bottom girder 9. Alternatively, the skeletal frame 5 may be assembled using bolts or other fasteners. The top girder 7 in a preferred embodiment is circular and preferrably fits tightly around the inner element 3. In alternative embodiments, the inner element 3 may be polygonal, having at least three sides, and the inner surfaces of top girder 7 and bottom girder 9 may be altered in shape accordingly to conform to the exterior shape of the inner element 3.

The top girder 7 has a joint protrusion 13 which is shaped to fit with the mating joint 15 of the bottom girder 9 of another manhole unit 1 in order to assemble a plurality of manhole units 1, as shown in FIG. 10, or to fit with the mating joint of the bottom of a prior art unit as shown in FIG. 11. The joint protrusion 13 and mating joint 15 are detailed in FIGS. 3–5, but many other shapes of joint protrusion and mating joint will be satisfactory and are within the skill of the art.

FIG. 2 depicts a top view of the manhole unit 1 and illustrates the skeletal frame 5 viewed from the top, the inner element 3 and inlet/outlet pipes 17. This view shows a preferred 20 embodiment wherein there are three columns 11 equally spaced about the skeletal frame.

Figure 3:
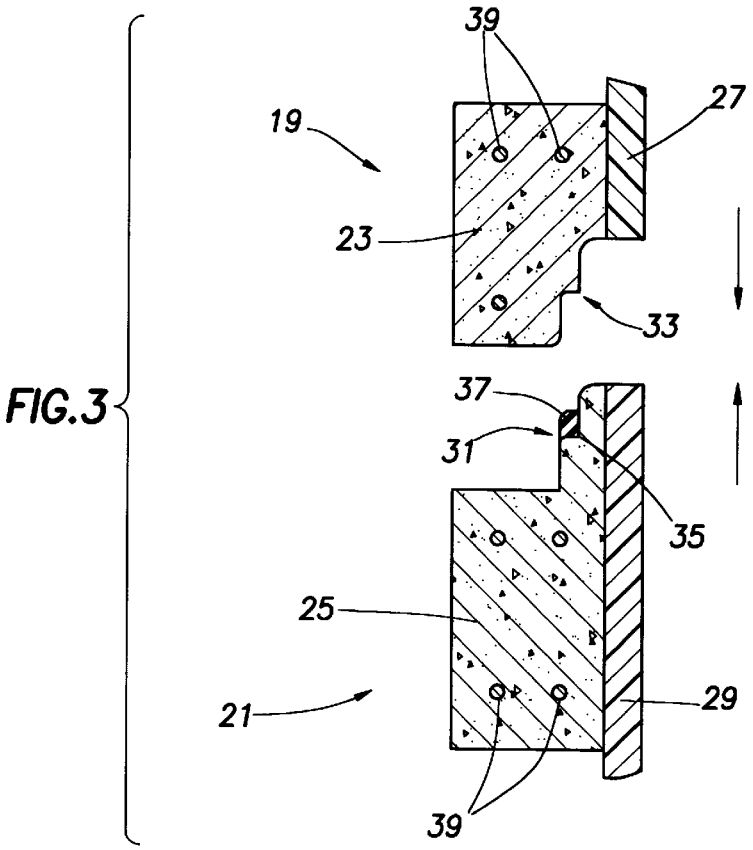
FIG. 3 is a partial cross sectional view of the step-shaped joining surfaces of an upper and lower unit with a gasket indicated.

FIG. 3 shows cross sections of portions of an upper unit 19 and a lower unit 21.

Only the bottom girder 25 of the lower unit 21 is shown, along with the top girder 23 of the upper unit 19. The concrete girders (and columns) are preferably reinforced with rebar 39 which are integrally cast in the concrete when the frame is made. The diameters of the rebar 39 may be the same or different depending on the structural requirements placed on the frame. The bottom girder 25 has a recessed mating joint 31 shaped to fit against the joint protrusion 33 of an adjacent unit (in this case lower unit 21). In this embodiment, the joint protrusion 33 is substantially step-shaped, having a pair of steps that fit into the corresponding step-shaped recess of the mating joint 31. A gasket 37 serves to seal the joint and is pictured at the corner 35 of the pair of steps of the joint protrusion 33, but may be placed at any appropriate surface of a joint.

Figure 4:
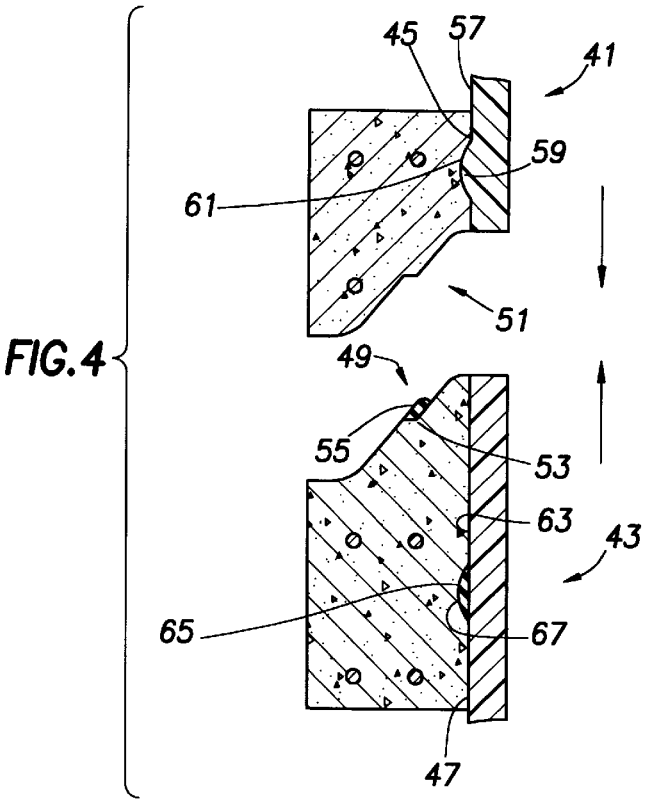
FIG. 4 is a partial cross sectional view of the slanted joining surfaces of an upper and lower unit with a gasket indicated. Also shown are an indentation/protuberance system and an indentation/grommet system of increasing the friction between the inner element and skeletal frame.

FIG. 4 shows a variation in joint construction. Again a partial cross section of an upper unit 41 and a lower unit 43 are shown. The lower unit 43 has a recessed mating joint 49 shaped to fit against the joint protrusion 51 of an adjacent unit (in this case upper unit 41). In this embodiment, however, the surfaces of the joint protrusion 51 are more slanted and curved than in FIG. 3. However, the joint protrusion 51 still fits into a corresponding recess of the mating joint 49. A gasket 55 is pictured at the corner 53 of the of the recessed mating joint 49.

The inner element 3 may be held in place by a variety of means, the simplest being friction between the adjacent surfaces of the inner element 3 and skeletal frame 5. If desired, it is possible to increase the friction between the skeletal frame 5 and the inner element 3. An example is shown in FIG. 4. The outer surface of the inner element 57 (of the upper unit 41) has a protuberance 59 that fits into a corresponding indentation 61 in the inner surface of the bottom girder 45. Alternatively, the indentation 65 of the inner surface of the top girder 47 in the lower unit 43 may be wholly or partially filled with a grommet 67. The grommet serves to increase the friction between the skeletal frame and inner element and is also capable of accommodating the different heat expansion rates of the two materials.

Additional means of frictionally securing the inner element is shown in FIG. 5. FIG. 5 is a partial cross sectional view of a bottom manhole unit (without a mating joint) which may be useful for the bottom-most unit of a manhole system (see also FIGS. 7 and 9 for special bottom-most manhole units). Labeled are the inner surface of the girder 69 and part of an inner element with an indentation 73 on the outer surface of the inner element 71. The corresponding protuberance 75 is provided by the inner surface of the girder 69. Of course, the protuberance/indentation system may be employed in the columns, though the system is only illustrated with respect to the girder.

FIG. 6 is a partial cross sectional top view of a manhole unit. It depicts a hollow protuberance 79 protruding from the outer surface of inner element 77 and having a hollow portion 81 forming, for example, a partial ring or partial tube that can be filled with concrete (as shown). The hollow portion 81 of the hollow protuberance 79 fills with concrete when the girders and columns are formed about the inner element. Thus, in this embodiment, the inner element and skeletal frame are permanently connected and shipped and assembled as a unit.

FIG. 7 depicts a partial cross section of upper and lower manhole units 83 and 85 respectively, showing both a simplified joint and a special bottom unit with sealing disk 107. The frames 87 and 89 are cross sectioned through the columns, as opposed to the earlier figures where only the cross section of a girder is shown. Upper frame 87 and receding end 93 of inner element 91 of the upper unit 83 combine to make a mating joint 111 of the upper unit 83. Likewise, lower frame 89 and top protruding end 97 of the inner element 95 of the lower unit (special bottom unit 85) combine to make a joint protrusion 109. As shown, the joint protrusion 109 and mating joint 111 are simplified versions from those previously illustrated. The inner elements 91 and .95 are not flush with the frames 87 and 89 respectively, but rather serve to create the joint protrusion 109 and mating joint 111. The joint is sealed with an O-ring 101 placed between the joint protrusion 109 and the mating joint 111.

The lower unit is a special bottom unit 85 with a bottom protruding end 99 of the inner element 95. The bottom protruding end 99 fits into a slot 105 of the sealing disk 107. In the illustrated embodiment, the slot 105 is shaped to receive the bottom protruding end 99 of the inner element 95, but it may also be shaped to receive part of the skeletal frame in other embodiments. A watertight seal is provided by a profile gasket 103 (for example, those available from Pine Gasket & Supply, Press Seal, Hamilton Kent or Delta Products) which may be placed against either the inside, outside or bottom of the inner element. Shown here is the profile gasket 103 against the outside of the inner element 95.

FIG. 8 is a partial cross section of a special bottom unit 113 with an integral base 119. The unit 113 has an inner element 117 with an inner element base 123 and a skeletal frame 115 with a skeletal frame base 121. The use of inner element 117 with inner element base 123 eliminates the possibility of joint leakage since there is no joint. The inner element 117 with integral inner element base 123 may alternatively be combined with a regular frame (see FIG. 1) and a sealing disk (see FIGS. 7, 9) may be added.

FIG. 9 is a partial cross section of a manhole unit 135 sealed with a sealing disk 125. The manhole unit 135 is joined to a sealing disk 125 at the base of the unit 135. The sealing disk 125 has an inner element 127 of the sealing disk 125 and a frame 129 of the sealing disk 125. The sealing disk 125 has a joint protrusion 133 adapted to fit the mating joint 131 of the manhole unit 135.

A plurality of manhole units 1 may be stacked on one another to form a manhole system 137 as shown in FIG. 10.

Figure 12:
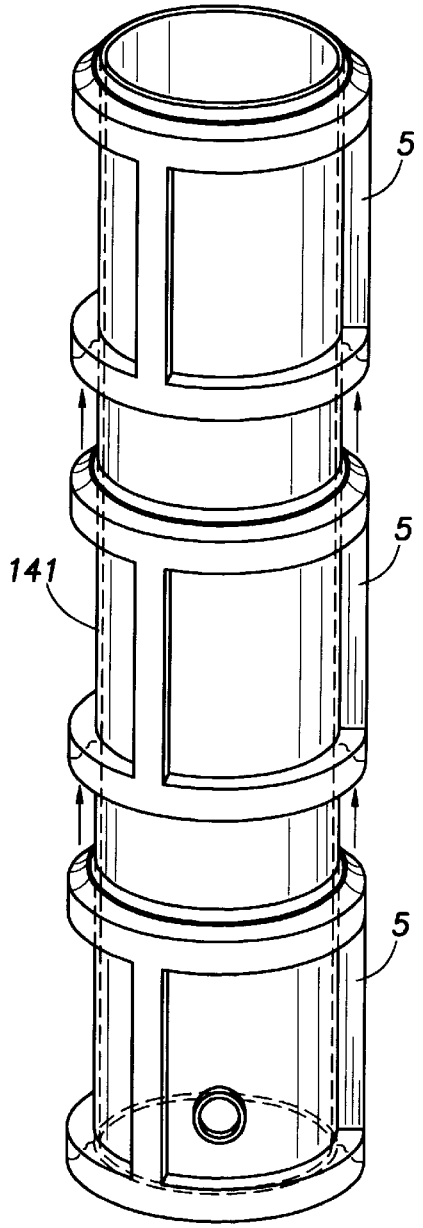
FIG. 12 is a perspective view of a manhole system which is formed when multiple skeletal frames are stacked one upon the other and combined with a single long inner element.

In such a system 137, the joint protrusion of one unit 1 is fit into and against the surface, preferrably a conforming surface, of the mating joint of another unit 1. An inlet/outlet pipe may be readily adapted and positioned on any of the manhole units 1 of the manhole system 137. Alternatively, a single manhole unit 1 can be combined with a prior art manhole 139 as in FIG. 11. In yet another embodiment, a single long inner element 141 is combined with a plurality of frames 5 as in FIG. 12. In this way, the number of joints in the manhole system can be minimized.

What is claimed is:

1. A manhole unit, comprising:

a rigid, skeletal, exterior frame having an inner surface;

an inner element comprising a corrosion resistant material and having an outer surface;

wherein the inner element is positioned within the exterior frame such that the inner surface faces toward the outer surface; and wherein the inner element is maintained within the exterior frame by friction.

2. A manhole unit according to claim 1, wherein the friction is created by a protuberance on the inner element fitting into a corresponding indention on the exterior frame.

3. A manhole unit according to claim 2, wherein the indention on the exterior frame is at least partially filled with a grommet.

4. A manhole unit according to claim 1, wherein the friction is created by-a protuberance on the exterior frame fitting into a corresponding indention on the inner element.

5. A manhole unit according to claim 4, wherein the indention on the inner element is at least partially filled with a grommet.

6. A manhole system comprised of a plurality of manhole units stacked upon one another; wherein each of the manhole units comprises:

a rigid, skeletal, exterior frame having an inner surface; and an inner element comprising a corrosion resistant material and having an outer surface;

wherein the inner element is positioned within the exterior frame such that the inner surface is adjacent to the outer surface.

7. A manhole system according to claim 6, wherein the exterior frame further comprises:

a plurality of girders that encircle the inner element; and a plurality of columns connecting the plurality of girders.

8. A manhole system according to claim 7, wherein the plurality of girders comprise:

a top girder with a first joint protrusion; and a bottom girder with a first mating joint, wherein the first mating joint is shaped to receive a second joint protrusion of a first adjacent manhole unit and the first joint protrusion is shaped to receive a second mating joint of a second adjacent manhole unit.

9. A manhole system according to claim 8, wherein the plurality of manhole units are sealed between the mating joint and the joint protrusions of an adjacent unit, to provide a watertight seal.

10. A manhole system according to claim 9, wherein the seal is selected from the group consisting of adhesives, gasket-like devices, solvent welding, heat welding and combinations thereof.

11. A manhole unit, comprising:

a rigid, skeletal, concrete, exterior frame having an inner surface;

an inner element comprising a corrosion resistant material and having an outer surface; and wherein the inner element is positioned within the exterior frame such that the inner surface faces toward the outer surface.

12. A manhole unit according to claim 11, wherein the exterior frame further comprises a reinforced material.

13. A manhole unit according to claim 12, wherein the reinforced material is selected from the group consisting of rebar, fibrous material and combinations thereof.

14. A manhole unit according to claim 12, wherein the exterior frame is coated with a second corrosion resistant material.

15. A manhole unit, comprising:

a rigid, skeletal, exterior frame having an inner surface, the exterior frame comprising a material selected from the group consisting of concrete, metal and combinations thereof;

an inner element comprising a first corrosion resistant material and having an outer surface, the first corrosion resistant material comprising plastic; and wherein the inner element is positioned within the exterior frame such that the inner surface faces toward the outer surface.

16. A manhole unit according to claim 15, wherein the plastic is selected from the group consisting of polyvinyl chloride, polyethylene, polypropylene, polyester and combinations thereof.

17. A manhole unit, comprising:

a rigid, skeletal, exterior frame having an inner surface;

an inner element comprising a corrosion resistant material and having an outer surface;

wherein the exterior frame includes a plurality of girders encircling the inner element and a plurality of columns connecting the plurality of girders, the plurality of girders comprising a top girder with a first joint protrusion and a bottom girder with a first mating joint, wherein the first mating joint is shaped to receive a second joint protrusion of a first adjacent manhole unit and the first joint protrusion is shaped to receive a second mating joint of a second adjacent manhole unit; and wherein the inner element is positioned within the exterior frame such that the inner surface faces toward the outer surface.

18. A manhole unit, comprising:

a rigid, skeletal, exterior frame having an inner surface;

an inner element comprising a first corrosion resistant material and having an outer surface;

wherein the inner element is positioned within the exterior frame such that the inner surface faces toward the outer surface; and wherein the exterior frame is coated with a second corrosion resistant material.

19. A manhole unit, comprising:

a rigid, skeletal, exterior frame having an inner surface;

an inner element comprising a corrosion resistant material and having an outer surface;

a locking system having a plurality of hollow protuberances projecting from the outer surface of the inner element and wherein the exterior frame at least partially fills the plurality of hollow protuberances; and wherein the inner element is positioned within the exterior frame such that the inner surface faces toward the outer surface.

20. A manhole system, comprising:

a plurality of rigid, skeletal, exterior frames, each having an inner surface;

an inner element comprising a corrosion resistant material and having an outer surface;

wherein each of the plurality of rigid, exterior, skeletal, exterior frames includes a plurality of girders encircling the inner element and a plurality of columns connecting the plurality of girders, the plurality of girders comprising a top girder with a first joint protrusion and a bottom girder with a first mating joint, wherein the first mating joint is shaped to receive a second joint protrusion of a first adjacent manhole unit and the first joint protrusion is shaped to receive a second mating joint of a second adjacent manhole unit; and wherein the inner element is positioned within the plurality of rigid, skeletal, exterior frames such that the inner surface of each of the plurality of rigid, skeletal, exterior frames faces toward the outer surface of the inner element.

21. A manhole unit, comprising:

a rigid, skeletal, exterior frame having a skeletal base and an inner surface;

an inner element comprising a corrosion resistant material and having a base and an outer surface;

wherein the exterior frame comprises a plurality of girders encircling the inner element and a plurality of columns connecting the plurality of girders, one of the plurality of girders being a top girder having a joint protrusion; and wherein the inner element is positioned within the exterior frame such that the inner surface faces toward the outer surface and the base of the inner element is adjacent to the skeletal base of the exterior frame.

22. A manhole unit, comprising:

a rigid, skeletal, exterior frame having a skeletal base and an inner surface;

an inner element comprising a corrosion resistant material and having a base and an outer surface;

wherein the exterior frame comprises a plurality of girders encircling the inner element and a plurality of columns connecting the plurality of girders, one of the plurality of girders being a top girder having a mating joint; and wherein the inner element is positioned within the exterior frame such that the inner surface faces toward the outer surface and the base of the inner element is adjacent to the skeletal base of the exterior frame.

23. A method of installing a manhole unit, comprising the steps of:

providing a manhole unit comprising a rigid, skeletal, exterior frame having an inner surface and an inner element comprising a first corrosion resistant material and having an outer surface, wherein the inner element is positioned within the exterior frame such that the inner surface of the exterior frame faces towards the outer surface of the inner element; and placing the manhole unit below ground.

* * * * *